United States Patent [19]

Lindstrom

[11] 4,144,782

[45] Mar. 20, 1979

[54] APPARATUS FOR CURVED SAWING OF TIMBER

[75] Inventor: Nils E. Lindstrom, Karlstad, Sweden

[73] Assignee: Skogsagarnas Vanerindustrier Aktiebolag, Karlstad, Sweden

[21] Appl. No.: 766,783

[22] Filed: Feb. 8, 1977

[30] Foreign Application Priority Data

Feb. 16, 1976 [SE] Sweden ..... 7601708

[51] Int. Cl.[2] ..... B27B 31/00

[52] U.S. Cl. ..... 83/102.1; 83/367; 83/420; 83/425; 83/732; 83/445; 83/446

[58] Field of Search ..... 83/367, 368, 732, 420, 83/421, 433, 439, 446, 449, 445, 102.1, 435, 425; 144/312, 346 R, 346 F

[56] References Cited

U.S. PATENT DOCUMENTS

| | | | |
|---|---|---|---|
| 339,797 | 4/1886 | Maxwell | 83/102.1 X |
| 1,263,443 | 4/1918 | Lien | 83/446 |
| 2,169,394 | 8/1939 | Richardson | 146/246 |
| 3,442,310 | 5/1969 | Mitten et al. | 144/312 |
| 3,858,631 | 1/1975 | Anderson | 146/246 R |

*Primary Examiner*—J. M. Meister

*Attorney, Agent, or Firm*—Larson, Taylor and Hinds

[57] ABSTRACT

Apparatus for sawing of curved-form timber feeds the log past a band saw such that the cut follows the curved form of the log. Spaced guides function to guide the log in a curved-form path through the saw. The guides are displaceable in a direction transversely to the feeding direction of the log depending on the curved form of the log. The guides may comprise guide rollers provided on each side of the log to be forced to the sides of the log.

7 Claims, 6 Drawing Figures

APPARATUS FOR CURVED SAWING OF TIMBER

The present invention relates to a saw mill and the invention is more particularly directed to an apparatus for feeding a log into a saw, preferably a band saw, so that the log is moved through the saw along the path which follows the curvature of the log.

For different reasons trees generally grow somewhat curved-formed and in order to make use of as large part of the wood as possible from such curved-formed timber the said timber previously used to be sawn such that the log was placed with its convexly curved surface turned vertically down, whereupon the log was edge sawn in a straight line path, and the edge sawn log was rotated 90° C. so as to lie on one of the edge sawn sides, whereby the log had a more or less curved form in a horisontal plane. In order to obtain as large part as possible of the said curved-formed log when heart split sawing the log in a straight line path, the heart split cut in the log used to be placed so that two substantially like large blocks could be obtained on each side of the heart split cut or the center split cut. This means that there will be a circle-segment-like waste portion on the convexly curved side of the log, whereas two wedge-like waste portions are obtained on the concavely curved side of the log.

A sawing like the above mentioned one involves a relatively large amount of waste material, and because of the fact that the curved log is sawn in a straight line path the said heart split cut will at least partly be located aside of the center of the log, whereby the saw cuts the fibres of the log and gives a relatively rough sawn surface.

It has therefore been suggested to make the heart split sawing along a curved-formed path which as closely as possible follows the curved form of the log so as to make use of the log mass at the maximum for providing sawn wood, and whereby two substantially like large blocks of the log are obtained, wherein the heart split cut of one block extends somewhat convexly whereas the heart split cut of the second block somewhat concavely.

The curved sawing of the timber can be made by manually displacing the rear end of the log to one direction or the other in a horisontal plane during the sawing, so that the heart split cut as closely as possible follows the center of the log. Such sawing however presupposes an extremely high skillfulness of the sawyer and depending on the difficulty to move the rear end of the log by a continuous movement the heart split cut often becomes uneven by following a slightly zig-zag formed path.

The object of the invention is to provide an apparatus for more or less automatically guiding the log through the heart split saw in a path which substantially exactly follows the curved form of the log.

Further characteristics of the invention will be evident from the following detailed specification in which reference will be made to the accompanying drawings. In the drawings FIG. 1 diagrammatically illustrates the method for conventional sawing of timber, whereas FIG. 2 in a corresponding view diagrammatically illustrates a curved sawing of timber.

Figure 1:
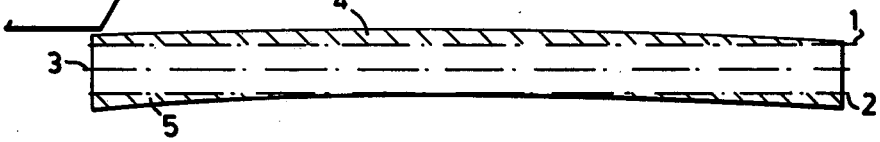
Fig. 1 PRIOR ART

In FIG. 1 a slightly curved formed log is shown in a plan cross section, which log when sawn in the conventional way following a straight line path at the maximum can give a block for providing deals and boards which is defined by the lines 1 and 2. The heart split cut of the said block is made following the straight line cut 3. On one side of the block a circle-segment-like waste portion 4 is obtained, and on the opposite side of the log two substantially wedge-like waste portions 5 are obtained. One object of the instant invention to make the heart split sawing by means of a cut 6 which as closely as possible follows the curved form of the log, whereby waste portions 7 and 8 respectively are obtained on each side of the log, which substantially solely depends on the fact that the log tapers towards the top end thereof. It is consequently possible by the curved sawing to almost completely eliminate the waste material which is otherwise obtained at conventional sawing following a straight line path.

The curved sawn timber after the blocks are dried and conditioned often straightens itself and the dividing sawing can in such cases just follow straight line paths of conventional saw equipments. It has however also been suggested that the dividing sawing should be made directly following the curved formed heart split sawing whereby the slightly curved blocks are pressed against a planing path so that the curvature of the log is straightened, whereby the dividing sawing also follows a straight line path.

Figure 3:
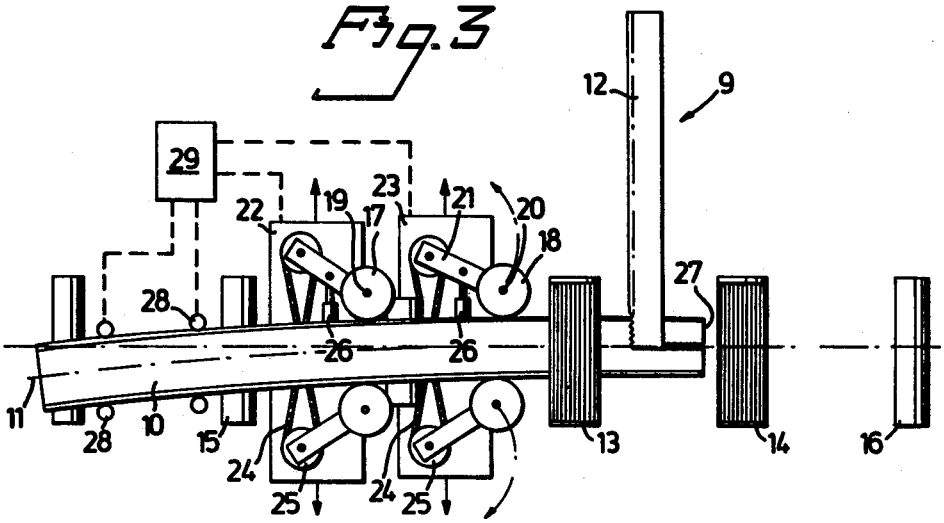
FIG. 3 is a diagrammatical plan view of a heart split saw for curved sawing of timber.
Figure 4:
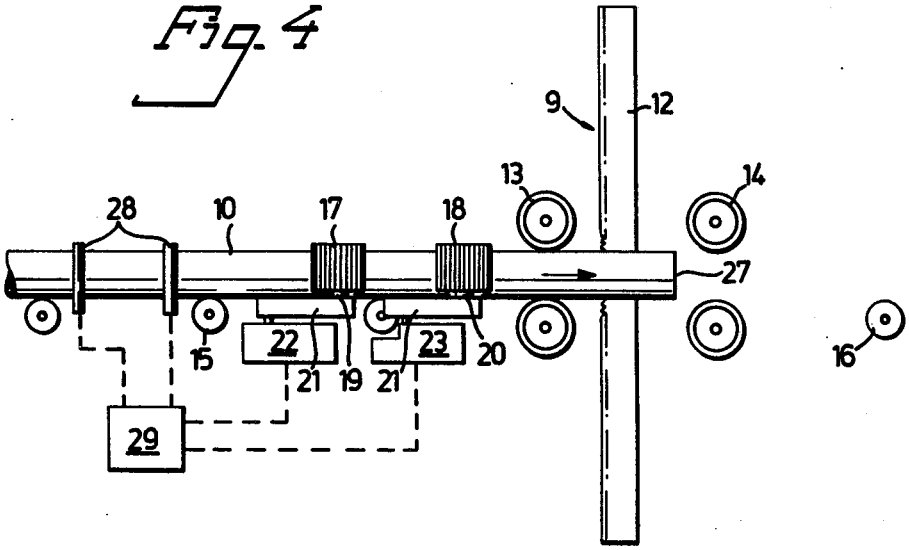
FIG. 4 is an elevational view of the saw according to FIG. 3.
Figure 2:
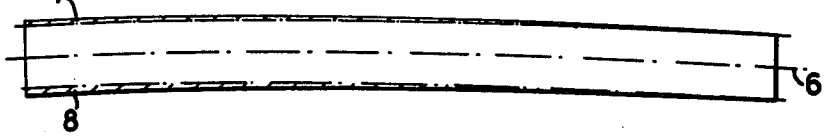

In FIGS. 3 and 4 is diagrammatically shown a heart split saw 9, through which a log 10 is brought to pass during the heart split sawing of the log by a cut 11 which as closely as possible follows the curvature of the log.

The heart split saw comprises a band saw 12 which on both sides of the saw is formed with feeder rollers 13 and 14 for feeding the log through the saw and support rollers 15 and 16 providing horizontal plane supporting the log while being fed through the band saw 12.

For guiding the log 10 towards the band saw there are two pairs of guide rollers 17 and 18 respectively which are mounted on vertical shafts 19 and 20 respectively, and the guide rollers 17 and 18 mounted spaced from each other along the feeder path of the log and they are with their shafts 19 and 20 mounted at one end of a rotatable arm 21 which with the opposite end is mounted in a transversely displaceable carriage 22, 23. The rollers 17 and 18 of each pair of rollers on either side of the feeder path of the log are mirror symmetrically provided and they are connected to each other by a chain provided in the form of an "8" which extends over chain sprockets 25. Thereby the guide rollers 17 and 18 respectively are mutually positively guided, so that an actuation and a displacement of the roller at the feeder path on one side of the log provides an exactly like large displacement of the roller on the opposite side of log. The rollers 17 and 18 respectively are actuatable by means of a hydraulic or pneumatic cylinder 26 which at one end is mounted in the carriage 22 and 23 respectively and which with the opposite end is connected to one of the rotatable arms 21. The transversely displaceable carriages 22 and 23 can be locked in any adjusted position and they are moved by means of hydraulic or pneumatic cylinders or by means of an electric motor (not shown).

When curved sawing of a log 10 the carriages 22 and 23 are adjusted so that the rollers 17 and 18 feed the front end 27 of the log to the saw with the center of the log exactly at the saw blade and so that the tangent for the curve line of the log at the said front end extends parallel with the direction of the saw blade. Since the guide rollers 17 and 18 are positively guided and are constantly pressurized by the cylinders 26 the log follows a path which is defined by the two pairs of guide rollers 17 and 18 respectively, and the log is heart split cut by the band saw 12 following a continuously curved path. If it should prove necessary either of the carriages 22 and 23 can be moved during the saw operation. If suitable the apparatus can be provided with indication means like indication rollers 28, photo cells or similar means engaging or observing respectively the vertical outer edges of the log some distance before the corresponding part of the log reaches the first pair of guide rollers 17 so as to give an indication of the curvature of the log and which means are connected to means 29 for automatically adjusting the position of the carriage 22 or 23 or both.

Alternatively the apparatus according to the invention can be provided with fixed mounted rollers 17 and 18 whereas the band saw 12 is displaceable transversely and in addition thereto rotatable about a vertical shaft so that the saw cut can be brought to extend curvely formed following the curved center line of the log.

Figure 5:
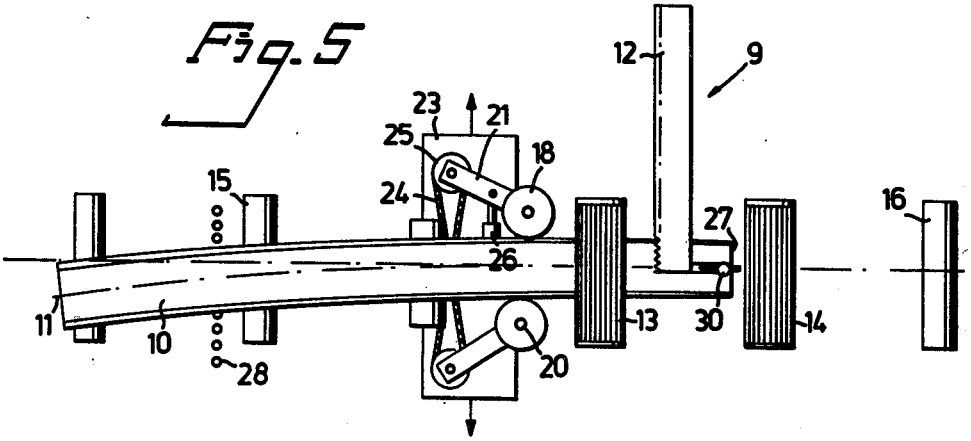
FIG. 5 is a diagrammatical plan view of an alternative embodiment of the apparatus according to the invention for curved sawing of timber.
Figure 6:
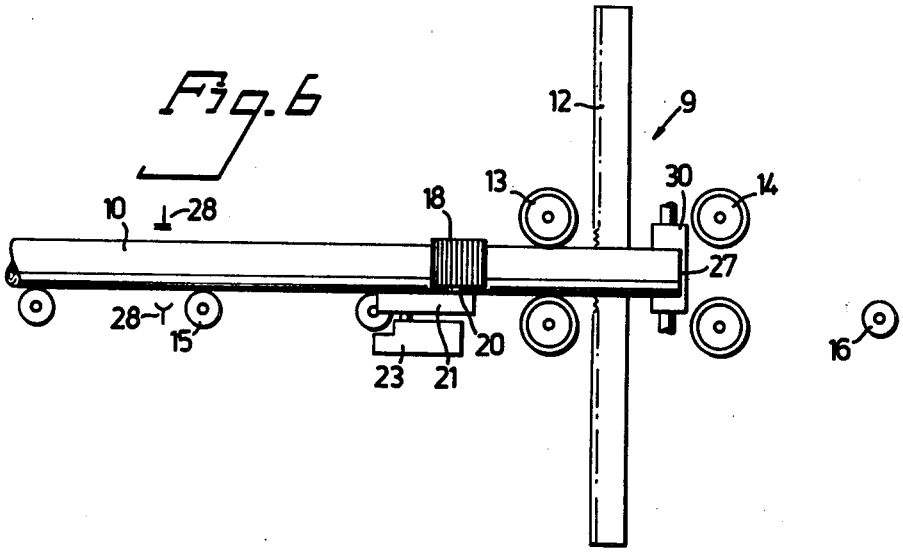
FIG. 6 is an elevational view of the saw of FIG. 5.

In the apparatus according to the invention shown in FIGS. 5 and 6 one of the pairs of guide rollers 17 is substituted by a vertically mounted knife 30 provided on the side of the saw 12 which is opposite the side with the guide rollers 18. The knife 30 is rotatably mounted about a vertical pin and it is as narrow as to fit the saw cut from the band saw 12. Together with the knife 30 the guide rollers 18 form a guide means which guides the log 10 past the saw 12 in a path, which substantially corresponds to the center line of the log. Also in the alternative embodiment of the invention shown in FIGS. 5 and 6 the carriage 23 can be moved transversely during the sawing operation, and if necessary also the knife 30 can be moved transversely for the adaptation thereof to the saw kerf. When feeding the log 10 into the saw 12 the log has to be manually displaced and fed until the knife 30 engages the saw kerf, whereupon the subsequent adjusting of the log is made automatically by means of the guide rollers 18 and the knife 30.

As a further alternative to the above described embodiments the apparatus can be formed with two pairs of guide rollers 17 and 18 respectively provided on either side of the band saw 12 or with two pairs of guide rollers 17 and 18 on one side and a guide knife 30 on the other side.

It is to be understood that the embodiments of the invention described above and shown in the drawings are only illustrating examples and that all kinds of modifications may be presented within the scope of the appended claims.

What we claim is:

1. Apparatus for sawing of curved-formed timber by means of a saw cut which as closely as possible follows the curved form of the log, which apparatus comprises a band saw and a horizontal feeder path associated therewith and provided with feeder rollers for feeding the log past the band saw, characterized in that the apparatus is provided with means for guiding the log in a curved-formed path past the band saw, comprising at least two spaced guide means providing guide points determining the curved-formed path along which the log is guided, at least one of which guide means comprises two mutually positively guided and vertically mounted guide rollers provided on respective sides of the log and having means for forcing said rollers to the sides of the log, the at least one pair of guide rollers being mounted on a carriage which is displaceable transversely to the moving direction of the log and can be locked in any selected position, and which carriage can be moved transversely also during the sawing operation.

2. Apparatus as claimed in claim 1 wherein said spaced guide means comprises a further pair of mutually positively guided and vertically mounted guide rollers provided on respective sides of the log and having means for forcing said further guide rollers to the sides of the log, said further pair of guide rollers being mounted on a further carriage which is displaceable transversely to the moving direction of the log and relative to said first mentioned carriage.

3. Apparatus as claimed in claim 2 wherein the two pairs of guide rollers are provided on the feed side of the band saw.

4. Apparatus as claimed in claim 1 wherein the guide rollers are mounted on pivotal arms which are positively connected to each other and are actuated by means of a fluid pressure piston-cylinder unit.

5. Apparatus as claimed in claim 1 further comprising means for sensing the curvature of the log and automatically adjusting the position of said carriage in accordance with sensed curvature.

6. Apparatus as claimed in claim 1 wherein said guide means includes a vertically mounted guide knife mounted on the opposite end of said band saw relative to said pair of guide rollers, and oriented for engagement with the saw kerf provided by said band saw.

7. Apparatus as claimed in claim 1 wherein both of said at least two spaced guide means are transversely displaceable.

* * * * *